United States Patent [19]

Goldfarb et al.

[11] 4,185,413

[45] Jan. 29, 1980

[54] TOY MILKABLE ANIMAL FIGURE

[75] Inventors: Adolph E. Goldfarb, 4614 Monarca Dr., Tarzana, Calif. 91356; Erwin Benkoe, deceased, late of Encino, Calif.; by Elisabeth Benkoe, executrix, 17965 Medley Dr., Encino, Calif. 91316; Elonne Dantzer, Redondo Beach, Calif.; William R. La Dow, Cincinnati, Ohio; Wayne M. Ginn, Independence, Ky.; L. Ray Dyson, Milford, Ohio

[73] Assignees: Adolph E. Goldfarb, Northridge, Calif.; Elisabeth Benkoe, Northridge, Calif. ; Executrix for the Estate of Erwin Benkoe

[21] Appl. No.: 876,419

[22] Filed: Feb. 9, 1978

[51] Int. Cl.[2] ..... A63H 13/02

[52] U.S. Cl. ..... 46/118; 46/123; 46/141; 222/78

[58] Field of Search ..... 46/141, 123, 118; 222/78

[56] References Cited

U.S. PATENT DOCUMENTS

| | | | |
|---|---|---|---|
| 2,536,518 | 1/1951 | Shrier | 46/123 X |
| 2,668,393 | 2/1954 | Rekettye | 46/141 X |
| 2,705,090 | 3/1955 | Odermatt-Wehrli | 222/78 |
| 3,122,130 | 2/1964 | Brown et al. | 222/78 X |
| 3,996,695 | 12/1976 | Sapkus et al. | 46/118 |

FOREIGN PATENT DOCUMENTS

| | | | |
|---|---|---|---|
| 235028 | 6/1925 | United Kingdom | 46/118 |

*Primary Examiner*—F. Barry Shay

*Attorney, Agent, or Firm*—Robert M. Ashen; Robert J. Schaap

[57] ABSTRACT

A toy milkable figure representative of an animal of the type capable of dispensing milk. The figure has a pivotally mounted head which may be pushed downwardly from an upper position to a lower position where a mouth opening in the head is immersed in liquid. The figure has a pivotally mounted tail which may be pumped up and down to create a liquid pumping action. The figure has an udder that forms a liquid holding chamber and has one or more flexible and squeezable teats. When the head is lowered into the liquid supply and the tail pumped, liquid is drawn into the mouth opening and delivered into the udder chamber. A liquid intake limiting mechanism causes the head to automatically raise out of the liquid after a predetermined amount of pumping. The teat has a valve device at its inner end whereby when the teat is squeezed the valve device closes to limit liquid flow back into the udder chamber and there is a positive squirting discharge from an outer aperture of the teat representative of that of a real animal. If the amount of liquid introduced into the udder is excessive, an overflow device allows the excess to escape through another teat. A sound generating device is coupled to the head to generate a mooing sound when the head raises.

23 Claims, 10 Drawing Figures

TOY MILKABLE ANIMAL FIGURE

BACKGROUND OF THE INVENTION

1. Purpose of the Invention

This invention relates in general to certain new and useful improvements in toy animal figures having an udder capable of dispensing a liquid upon squeezing a portion thereof, and more particularly, to toy animal figures of the type stated which is provided with means for automatically limiting the in-take of liquid to the udder and with a unique means for controlling the flow of liquid from a test on the udder.

2. Brief Description of the Prior Art

Applicants are aware of toy animal figures which housed a flexible liquid holding bulb connected to a rigid udder simulating a portion of the toy animal figure. When the bulb was compressed, the liquid would flow out of the udder. In addition to the above, Applicants are also aware of various forms of doll figures with the capability of receiving and holding water which was released when the doll was positioned on a toilet seat or similar waste liquid disposal system. There have been other forms of dolls which received water flowing directly through the doll into a diaper. Further, there have been several novelty figures in the prior art where a liquid holding bulb was attached by means of a tube to the doll in such a manner that discharge of a liquid from the bulb created the appearance of the figure urinating.

Applicants are also aware of co-pending patent application Ser. No. 772,012 dated Feb. 25, 1977 for a toy milkable animal figure. If the aforesaid patent application, the toy animal figure represents a cow having an udder with a squeezable teat on its underside which is capable of discharging liquid when squeezed. Water is introduced into the animal figure by immersing the mount portion in a trough of water and pumping the tail. This water is delivered into the udder. To deal with the problem of excess water being delivered to the udder, a two-way valve system is provided for returning excess water from the udder back to the trough. Such valve system includes a first tube to bring water from the trough into the udder and a second tube for recirculation of excess water back to the trough. Thus, no means are provided for automatically limiting the intake of liquid into the udder; excess liquid is simply recycled as long as pumping continues.

OBJECTS OF THE INVENTION

It is, therefore, a primary object of the present invention to provide a toy milkable animal figure which is capable of taking liquid into a chamber representative of an udder and which includes a unique liquid in-take limiting means for limiting the in-take of liquid when the chamber is filled thereby eliminating the need of a recirculating system.

It is a further object of the present invention to provide a toy animal figure of the type stated in which reciprocative shifting of the tail or other appendage of the animal figure creates a pumping action to cause in-take of a liquid and where the head of the animal will automatically raise from a drinking position after a predetermined number of shifting actions of the tail or other appendage of the animal figure.

It is another object of the present invention to provide a toy animal figure of the type stated which includes a unique valve means controlling liquid flow into a teat on the udder of the toy animal figure thereby enabling a positive squirting discharge resembling that of a real animal and thereby increasing the authenticity of the discharge action.

It is another object of the present invention to provide a toy milkable animal figure of the type stated which includes means which operate in cooperation with the in-take limiting means to generate sound from the animal figure representative of the sounds normally made by an animal represented by the toy animal figure.

It is also an object of the present invention to provide a toy milkable animal figure of the type stated which can be constructed at a relatively low unit cost.

It is another salient object of the present invention to provide a toy milkable animal figure of the type stated which can be constructed with many commercially available components and assembled in a relatively simple manner and which lends to reduced cost of manufacture.

It is an additional object of the present invention to provide a toy animal figure of the type stated which includes a unique overflow chamber located in the udder of the animal figure permitting discharge through one of the tests on the animal figure if an excess of liquid is introduced into the udder of the animal figure.

With the above and other objects in view, our invention resides in the novel features of form, construction, arrangement and combination of parts presently described and pointed out in the claims.

SUMMARY OF THE DISCLOSURE

The present invention relates to a toy milkable animal figure, illustrated in the form of a toy milkable cow. The cow is provided with four depending legs so that it is capable of standing in an upright position on a floor, table or other supporting surface. The illustrated cow has a head pivotally mounted for movement between an upper position and a lower position where the head is in a so-called "drinking" position.

A tail is pivotally mounted on the rearward end of the illustrated cow. The tail has a compression head which engages the upper end of a bellows that is compressible and expandable. The bellows is compressed and expanded by pumping the tail. The lower end of the bellows is connected through a liquid delivery tube to a mount opening on the head of the cow. The mouth opening is immersed in a supply of liquid such as water in a trough when the head is in the lowered position. When the bellows contracts, it expells air therefrom and when it expands, it causes a vacuum therein and will thereby cause liquid to be sucked in through the mouth opening and through the liquid delivery tube into the bellows. The liquid will drain from the bellows into an udder located on the rear underside of the cow. Thus, as the tail is pumped, water is carried to the udder. The head will remain in the trough for a predetermined number of pumping cycles of the tail and will thereafter move to its upper position out of the trough.

A one-way check valve is located in proximity to the mouth opening and at the outer end of the delivery tube to prevent liquid flow back into the supply of liquid. An additional one-way check valve is located intermediate the bellows and the udder to prevent any air in the udder and in a liquid delivery chamber immediately above the udder from being sucked back into the bellows when the bellows expands.

In the operation of the toy animal figure, the child-user pushes the head downwardly into the trough and pumps the tail. Water will be taken into the mouth and delivered to the udder. After the predetermined amount of pumping, the head rises out of the trough and the user can stop further pumping.

The illustrated udder is provided with one or more teats and at least one of these teats is flexible and resilient and is provided with an aperture that opens when the teat is squeezed to discharge liquid. Thus, the child-user will grasp one of the teats and squeeze it to milk the cow. The udder may be provided with a composition, such as a tablet disposed within the udder, in order to turn the water introduced into the udder into a white liquid representative of milk. In this way, the child-user can learn that a cow can ingest water and produce water, which not only provides entertainment value but educational value as well.

The means within the illustrated cow to raise the head at the determined time include a ratchet wheel which is engaged by a pawl pivotally connected to the compression head on the tail. The ratchet wheel will rotate through a predetermined arc through action of the pawl when the tail is pumped in the predetermined number of reciprocative actions. A star-wheel is rotatable with the ratchet wheel and cooperates with a camming arm which engages camming surfaces on the head. Three such star-wheel flanges engage the cam follower arms which, in turn, cause movement of the cam follower arms with respect to the camming surfaces on the head.

The head is normally biased in an upper or upward position and can be shifted to the lower or so-called "drinking" position by pressure on the head by the child-user. In the upper position, the camming arm rides over arcuate camming surfaces on the head. However, when the head is pushed to the downward position, the cam follower arms engage a shoulder which holds the head in the lower position. In this case, the head will remain in the drinking position until the star-wheel connected to the ratchet wheel engages an actuating arm rigidly connected to the cam follower arms. The actuating arm is urged in a direction to force the cam follower arms out of engagement with the shoulder, which thereby permits the head to be spring biased to the upward position.

As indicated above, the movement of the head from the drinking position to its upper position is effected by a predetermined number of pumping actions of the tail. However, it should be understood that other forms of pumping and liquid intake limiting mechanisms may be employed.

The teat which discharges the liquid representative of milk is provided with a valve mechanism at its upper end. This valve mechanism is designed to control liquid flow between the teat and the udder. When the child-user squeezes the teat, the valve will close limiting further flow of liquid from the udder into the teat and also preventing back flow of liquid from the teat into the udder. Thus, only the water within the teat will be discharged to more closely resemble the actual "milking" or squeezing of the teat of a real cow. Thereafter, upon releasing the teat, water will flow through the valve into the teat again, and when further squeezed, the new amount of water introduced therein will be discharged in the same manner.

The toy milkable cow of the present invention does not include a recirculation system for recirculating water back to the trough when the udder is filled. As noted above, the head raises to limit the water introduced into the udder. However, overflow means are provided to deal with excess water which will result for example if the limiting mechanism malfunctions or if the child-user pushes the head down into the trough without first emptying the udder. In this connection, one of the teats other than the squeezable one is open at its lower end and is provided with an overflow wall extending upwardly into the udder. Thus, if the child-user should push the head of the animal into the trough after the first predetermined number of cycles of pumping the tail, liquid in an amount greater than the system is capable of holding would be introduced. In this case, the excess water would flow over the overflow wall and out through the opening in the associated teat.

The illustrated cow is also provided with a sound generating device capable of generating a mooing sound in cooperation with the filling of the udder. The illustrated sound generating mechanism is actuable by the shiftable movement of the head. Thus, when the head is shifted from a drinking position to an upper position, it will actuate the sound generating mechanism to produce a mooing sound.

BRIEF DESCRIPTION OF THE DRAWINGS

Figure 1:
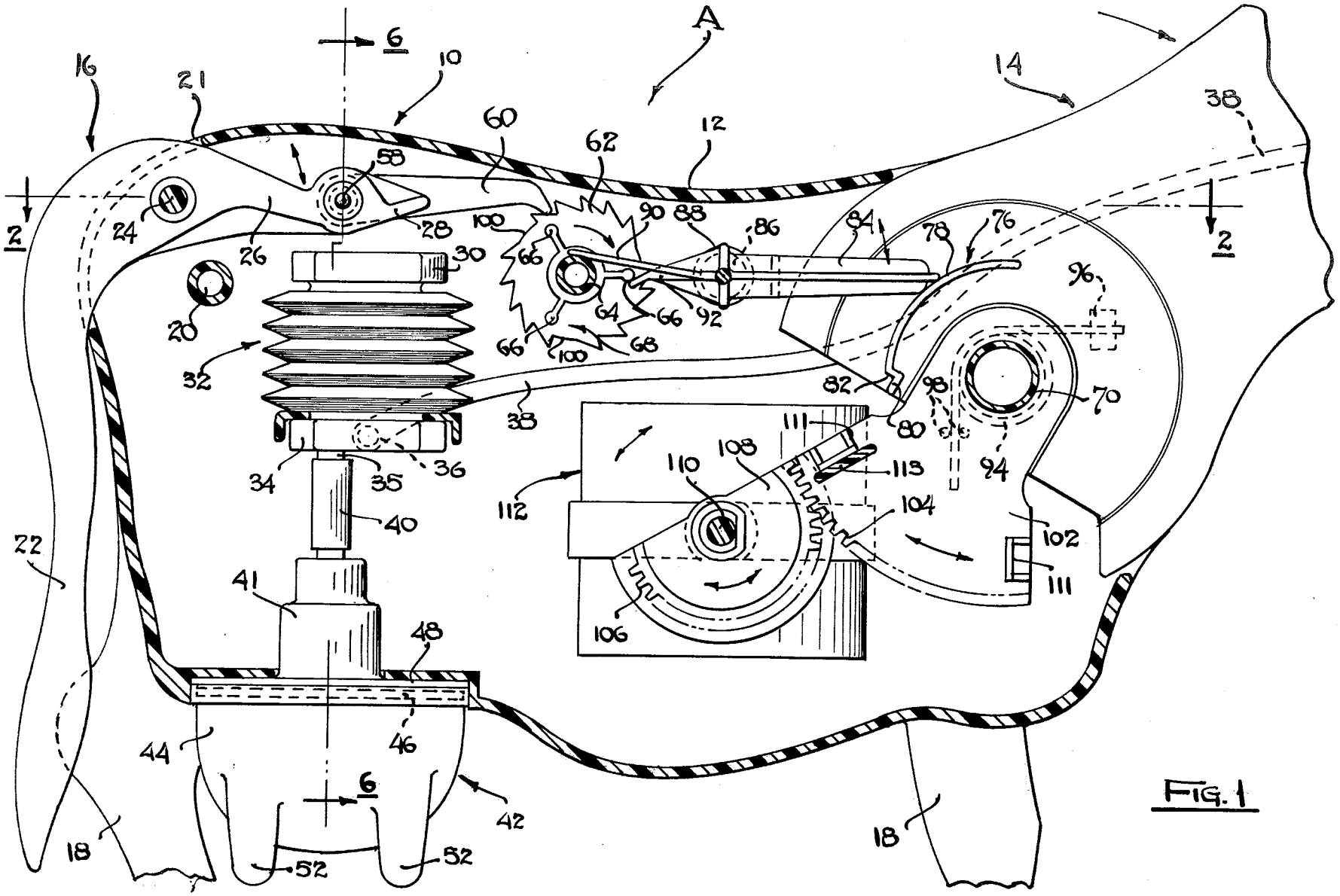
Figure 2:
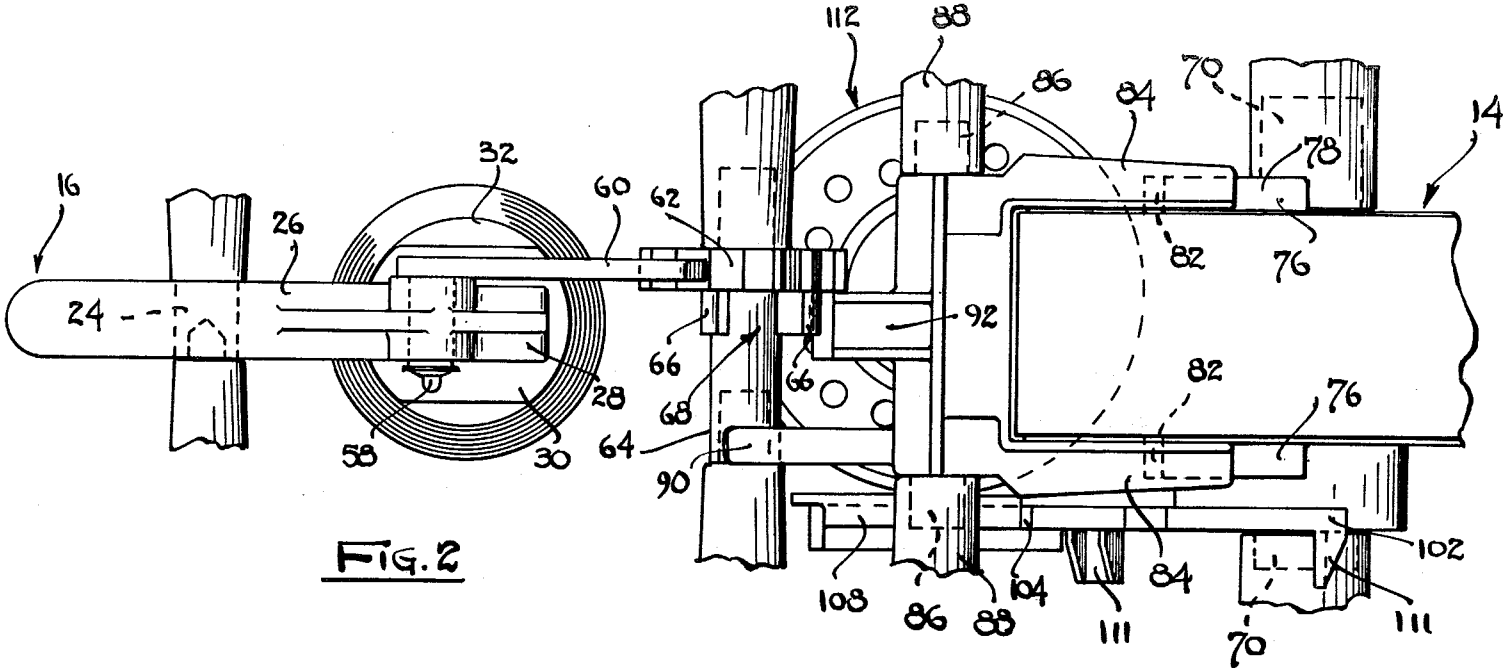
Figure 3:
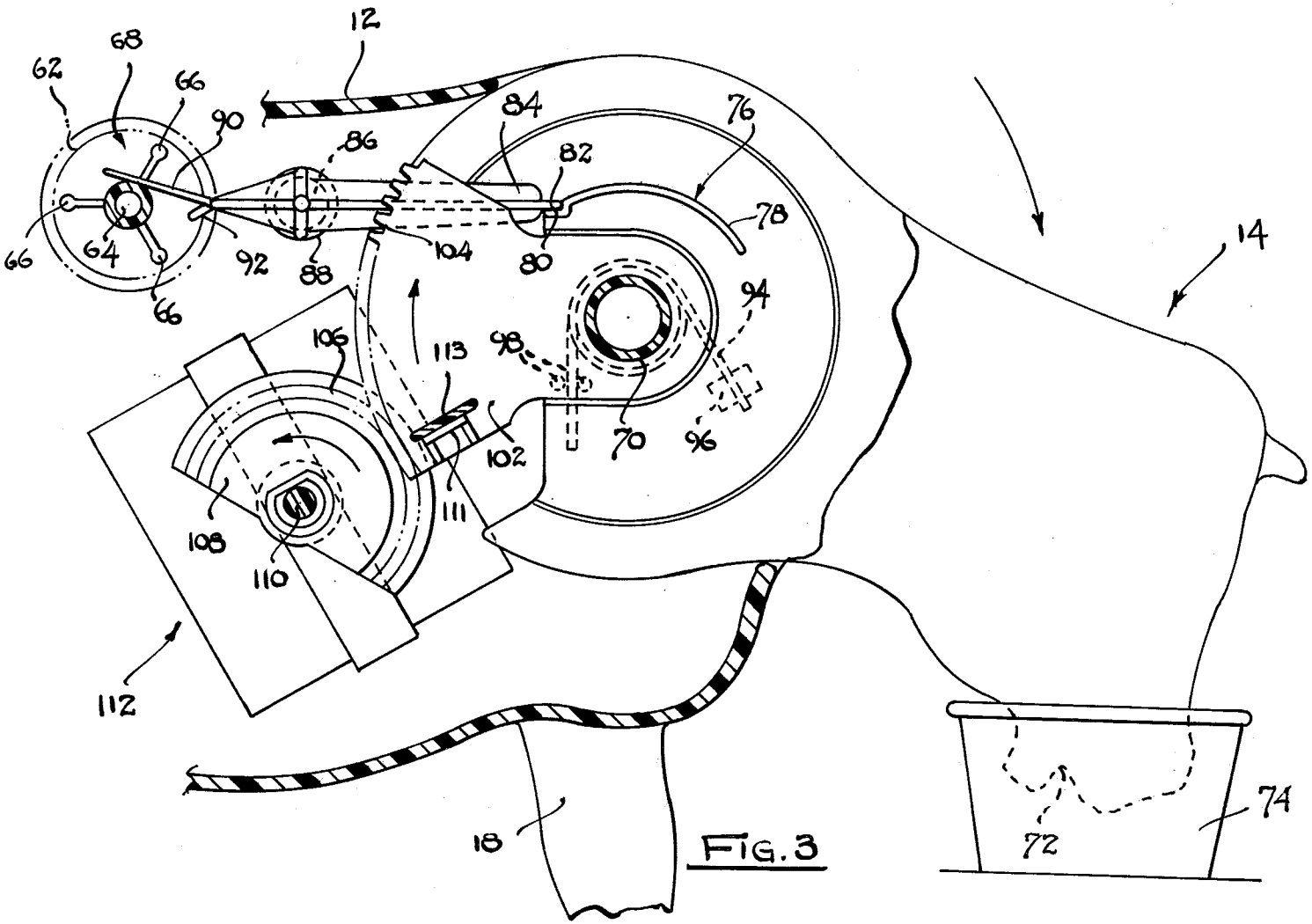
Figures 4, 5:
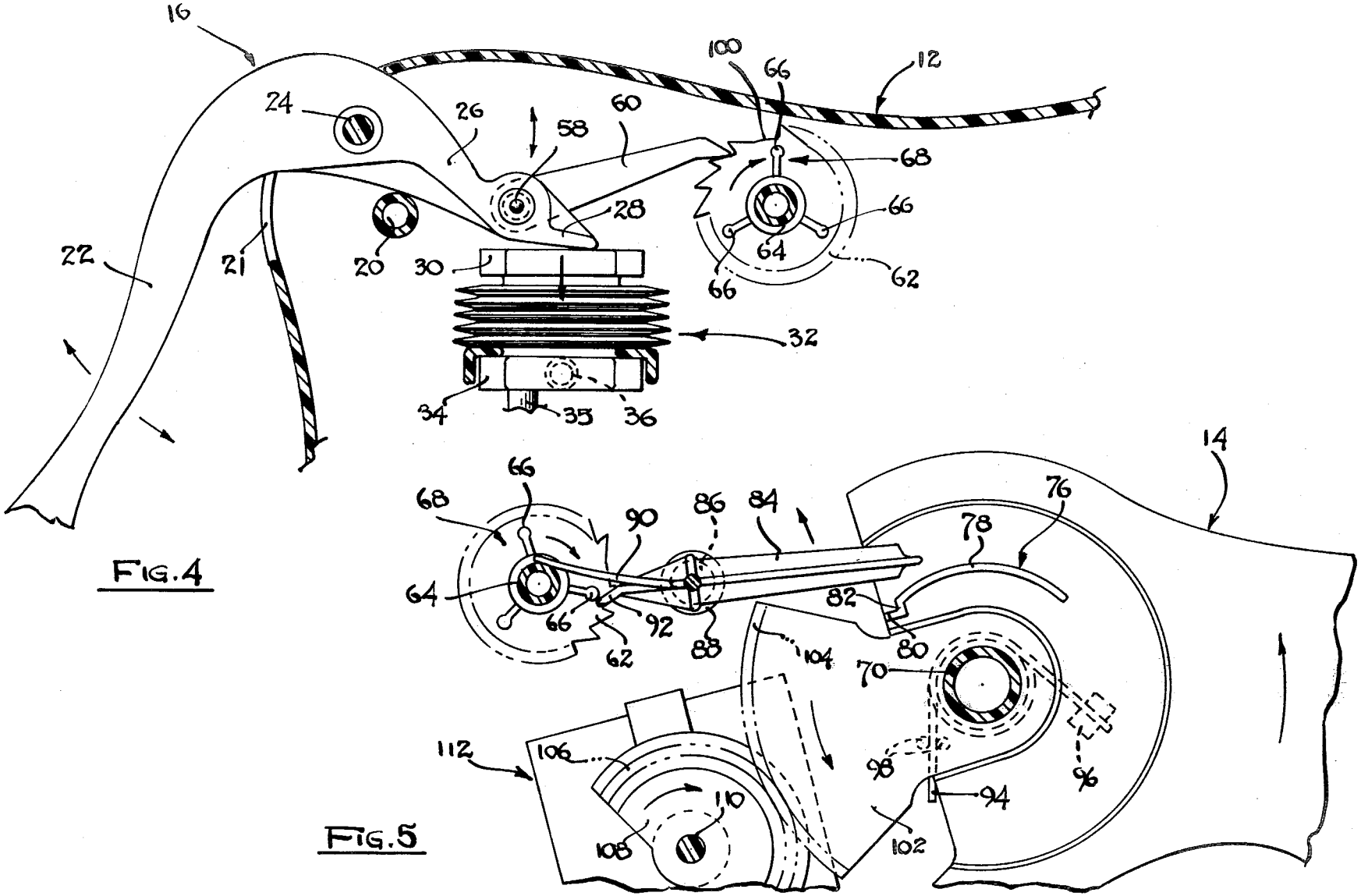
Figure 6:
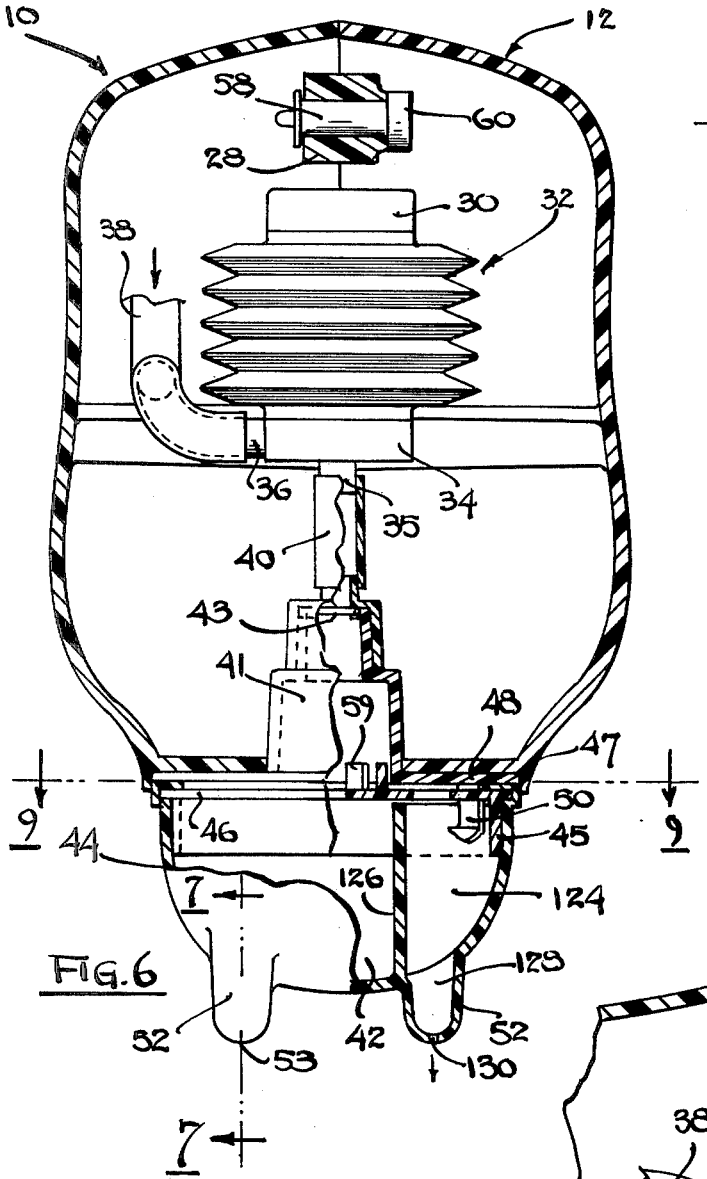
Figure 7:
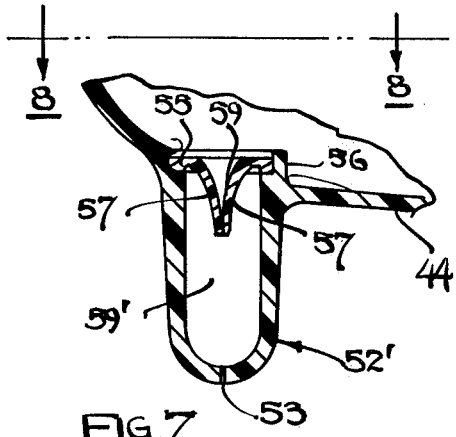
Figure 8:
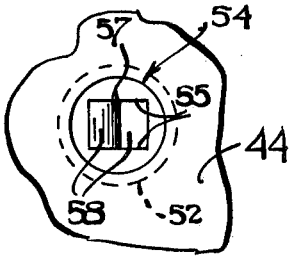
Figure 9:
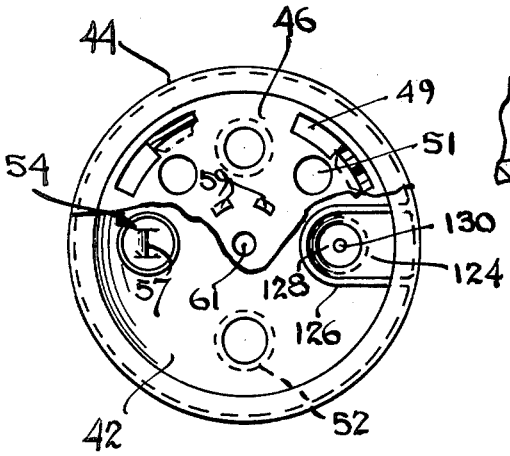
Figure 10:
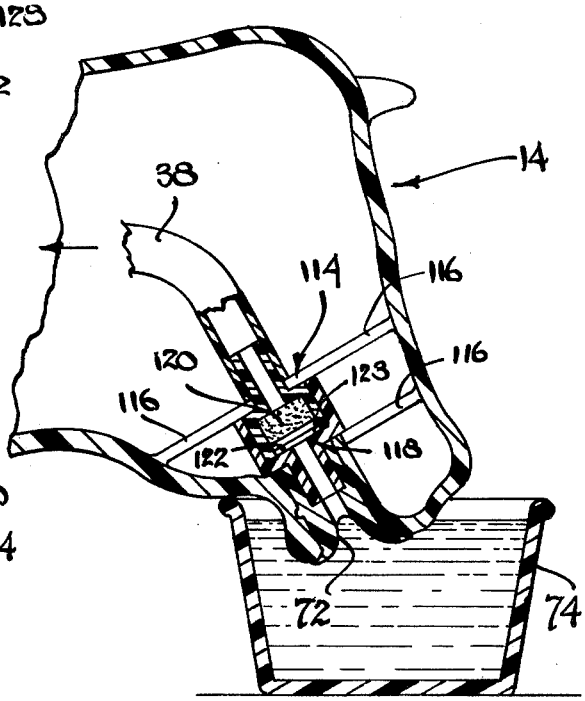

Having thus described the invention in general terms, reference will now be made to the accompanying drawings in which:

FIG. 1 is a fragmentary side elevational view, partially broken away and in section, of a preferred form of the invention in the form of a toy milkable cow figure;

FIG. 2 is a fragmentary horizontal sectional view taken along line 2—2 of FIG. 1;

FIG. 3 is a fragmentary side elevational view, partially broken away and in section, and showing the toy milkable cow figure with the head portion thereof lowered into a pail containing a liquid;

FIG. 4 is a fragmentary side elevational view, partially broken away and in section, and showing a portion of the tail and operation for pumping a liquid into a bellows;

FIG. 5 is a fragmentary side elevational view, partially broken away and in section, and showing a portion of the mechanism for raising and lowering the head of the toy animal figure;

FIG. 6 is a vertical sectional view, taken along line 6—6 of FIG. 1;

FIG. 7 is an enlarged fragmentary vertical sectional view taken along line 7—7 of FIG. 6 and showing one of the teats on an udder of the figure of the present invention;

FIG. 8 is an enlarged fragmentary top plan view taken substantially along line 8—8 of FIG. 7 and showing a valve in the teat of FIG. 7 of the toy milkable animal figure;

FIG. 9 is a top plan view, partially broken away and taken substantially along line 9—9 of FIG. 6 and showing the udder details including a portion of the overflow means included in the animal figure of the present invention; and FIG. 10 is a fragmentary vertical sectional view showing a portion of the valve mechanism included in the head of the toy animal figure.

DETAILED DESCRIPTION OF A PREFERRED EMBODIMENT

Referring now in more detail and by reference characters to the drawings, A designates a toy animal figure, preferably in the form of a cow, and which comprises an outer body or frame 10 which comprises a torso 12 having a pivotal head section 14 and a pivotal tail section 16. The torso is integrally provided with four depending legs 18 which are capable of engaging a horizontal support surface, such as table, floor or the like, and holding the toy animal figure in an upright position.

In the present invention, the torso section, along with the legs 18 integral therewith, are formed of corresponding longitudinal half sections or torso shells which are secured together and generally snap-fitted together in a secured arrangement. The two torso half section shells are provided with inwardly extending protrusions which fit within inwardly extending bosses having recesses 20 for purposes of snap-fitting the two shell sections together.

The tail section 16 extends outwardly through a slot 21 formed within the rearward end of the torso in the manner as illustrated in FIG. 1 of the drawings. The tail section 16 includes a downwardly struck elongate tail 22 and which is pivotally secured within the torso 12 by means of a transversely extending pivot 24. The elongate tail 22 integrally merges into a forwardly struck arm 26 which is formed with an enlarged contact head 28 capable of engaging the upper end of a bellows 32. The bellows 32 operates as a type of pump and is provided with a lower or base section 34 in communication with the interior chamber formed by the bellows. The base section 34 is provided with a drain pipe 35 as hereinafter described and a fitting 36 integrally formed therewith. The fitting 36 is connected to a plastic tube 38 which extends into the head section 14 in a manner to be hereinafter described in more detail. The plastic tube 38 is designed to receive a liquid, such as water, taken in through the head section and delivered to the lower section 34 forming part of the bellows.

By reference to FIGS. 2 and 4, it can be observed that when the tail section is pulled upwardly, that is in a clockwise direction, to the position as illustrated in FIG. 4, the contact head 28 will engage the upper section 30 of the bellows and squeeze and thereby compress the bellows. When the tail 22 is released and permitted to shift back or otherwise pushed back to its initial position as illustrated in FIG. 1, the compressed bellows will thereupon expand, creating a vacuum therein. As this occurs, the liquid, such as water, at the intake in the head section 14 will be sucked in through the tube 38 into the bellows section 32. At this point, the liquid is thereupon permitted to drain downwardly through the fitting 35 and a flexible tube 40 connected to the fitting 35, and into an enlarged head 41 on a chamber forming means 42. A one-way check valve 43, e.g. a simple flapper valve, is located in the enlarged head 41 beneath the tube 40, as illustrated in FIG. 6, to prevent any air in the chamber forming means 42 from being sucked back into the bellows 32 during expansion thereof. Moreover, this valve 43 will also assist in preventing back liquid flow into a source of the liquid.

The chamber forming means 42 may adopt the form of an udder 44 which extends beneath the lower portion of the torso 12 near the rearward end thereof. The udder 44 is formed of a fairly flexible resilient material, such as a rubber material, so that it can be squeezed. The udder is disposed about the downwardly struck annular flange 45 on a plate 46. The udder has an inwardly struck annular flab 47 surrounding a peripheral portion of the plate 46. The plate 46 cooperates with a mating plate 48 secured to the mating portions of the torso section and which is spaced slightly thereabove.

The plate 46 is provided with a plurality of circumferentially spaced bayonette slots 49 to receive depending bayonette type prongs 50 on the plate 48. Thus, rotation of the plate 46 with respect to the plate 48 through a slight arc will mount the plate and the udder carried therewith to the plate 48, and hence the body of the animal. Rotation in the opposite direction will permit removal of the plate 46 and the udder 44 carried thereby. It can be observed that when the plate 46 is mounted to the plate 48 a slight camming action will occur, thereby creating a tight-fitting engagement of the flap 47 between the two plates 46 and 48 with a water tight seal therebetween. In addition, the bayonette slots 49 and the prongs 50 are so located to provide a keying arrangement between the two plates 46 and 48. In this way, the two plates 46 and 48 can only be oriented in the same position relative to each other and hence teats (hereinafter described) on the udder will always be located in the same relative position when the plate 46 and udder 44 are removed and reassembled. Thus, the child user will always know which teat permits liquid discharge.

Liquid which is entered into the fitting 35 and the flexible tube 40 will thereupon drain into the udder 44 through a plurality of apertures 51 formed in the plate 46. In this way, liquid which is sucked into the rear section of the torso 12 by action of the bellows 32 will be permitted to accumulate within the udder 44.

The udder 44 is provided with a plurality of downwardly extending teats 52, much in the same manner as the teats on the udder of a cow or similar animal. The teats are similarly formed of a flexible resilient material, such as a rubber, and are integral with the udder 44.

One of the teats designated as 52' has a small aperture or opening in the form of a small slit 53 in its lower end. The opening would normally be in a closed position to retain the liquid within the teat 52'. However, upon squeezing or manipulation of this teat, the teat will open in a manner hereinafter described in more detail and permit a discharge of the liquid contained within the teat 52'.

This latter teat 52' is also provided with a valve 54 at its upper end where the teat 52 is jointed to the udder 44. The valve 54 is more fully illustrated in FIGS. 7 and 8 of the drawings and is comprised of a flat rubber disc or ring 55 which is fitted within a recess partially formed by a cylindrically shaped upstanding rim 56. By reference to FIG. 7, it can be seen that the rim 56 is integral with the material forming part of the udder 44 and surrounds at least a portion of the opening in the material leading into the teat 52'. The ring 55 is preferably sealed to the surface of the udder material in the recess and inside of the rim 56 by a suitable adhesive which will form a liquid-tight seal.

The valve 54 is comprised of a pair of opposed downwardly extending wall segments 57 on the ring 55 which extend downwardly therefrom and are formed of a fairly resilient plastic material. Each of the wall segments have opposed inwardly presented sealing faces 58. The two sealing faces 58 can contact each other, particularly at the lower ends thereof along a valve sealing line 59 to form a type of valve seal.

In the normal or unsqueezed position, the sealing faces 58 are in contact with each other along the sealing line 59, but not necessarily in liquid-tight contact to seal against liquid flow, although liquid flow would largely be restricted. When the sealing faces 58 are spaced apart from each other relative to the sealing line 59, as hereinafter described in more detail, they will thereby form an opening permitting communication between the udder and a central chamber 59' in the teat 52'. This will permit the chamber 59' in the teat 52' to fill with the liquid such as water contained in the udder 44.

The slit 53 is formed in the lower end of the teat 52' by a simple cutting action after the teat 52' is formed, as for example a simple slitting action with a knife. Inasmuch as no material is removed during the forming of the slit 53, it will tend to remain in a closed position since the material forming the lower end of the teat 52' tends to assume its original position. Thus, the slit 53 will remain closed, even when the chamber 59' of the teat 52' is filled with liquid, until pressure as for example by a squeezing action, is applied to the teat 52'.

Assuming that the teat 52' is filled with liquid, the child user may squeeze the chamber 59' of the teat 52' in order to discharge liquid in the chamber 59' through the slit 53. When pressure is applied to the teat 52' as by squeezing, the liquid in the chamber 59' will be under pressure. Due to the construction of the valve 54, the sealing faces 58 will be forced together either by a squeezing force applied to the exterior of the teat 52' or otherwise by the hydrostatic force exerted on the lower portions of the flat exterior portions of the wall segments 57. It can be observed that opposed lines of force applied to the wall segments 57 will force the sealing faces 58 together in a sealing engagement along the valve sealing line 59, thereby preventing any further liquid flow between the chamber 59' of the teat 52' and the udder 44. The primary purpose of the valve 54 during the squeezing action, is to prevent the liquid in the chamber 59' from being forced back into the udder 44. However, the valve 54 also provides the added advantage of preventing liquid in the udder from entering the chamber 59' during manipulation of the teat 52'. During the squeezing action, the hydrostatic pressures on the slit 53 will cause the slit 53 to open and the liquid in the chamber 59' of the teat 52' will be forced out through the slit 53. This construction provides a more realistic feel and realistic discharge of the liquid from the teat. In this way, when the teat 52' is squeezed, a certain amount of liquid will be discharged from the teat with a positive force on each squeezing action.

The child user will release the teat 52' when all of the liquid in the chamber 59' has been discharged therefrom. Upon releasing of the squeezing action on the teat 52', the slit 53 will close. The sealing faces 58 will remain in their contacted position, although not necessarily in sealing contact. This will cause a vacuum in the chamber 59'. This pressure differential will cause liquid to be sucked into the chamber 59' through the valve 54 from the udder 44, thereby forcing the sealing faces 58 to separate. In this way, liquid in the udder will fill the chamber 59' of the teat 52' to permit the start of another discharge cycle by squeezing the teat 52' to discharge liquid. It should be understood that the valve 54 does not have to create a perfect seal since some leakage can be permitted without affecting the operation of the toy animal figure. The same also holds true of the slit 53.

The slit 53 acts as a type of valve in that it will remain closed when no force is applied to the side of the teat 52', and will open when a hydrostatic force is created in the chamber 59', e.g. by squeezing the side of the teat 52'. As indicated previously, the slit normally tends to close by virtue of the fact that no material was removed from the lower end of the teat 52' during formation of the slit 53. In addition, it is theorized that the somewhat hemispherical construction at the lower end of the teat 52' will permit a pressure differential across the slit 53 such that the air pressure on the exterior of the slit is greater than the pressure exerted on the slit by the liquid in the chamber 59' of the teat 52' when the teat is not squeezed. However, when the teat 52' is squeezed, the pressure differential changes so that the hydrostatic pressure created inside the chamber of the teat 52' by application of force to the side of the teat 52' is greater than the external air pressure permitting the slit 53 to open and discharge the liquid from the chamber 59'.

The slit 53 operates as a type of check valve and moreover operates in conjunction with the valve 54. In this way the combination of the valve 54 and the slit 53 in the teat 52' operate as a type of pump in order to effectively pump liquid from the udder 44 into the chamber 59' of the teat 52'.

In a preferred aspect of the present invention, the teats, and particularly the teat having the openings therein, are approximately one-fourth to one-half inch long or at least sufficient in length so that it may be grasped near its open end by a child and squeezed to produce a discharge out of the teat. Constructing the udder as well as the teat out of a flexible plastic material not only provides for the operation as noted above, but also provides realistic simulation of the feel of an udder of a real animal.

A suitable dye or pigment may be provided in the udder 44 such that the liquid, such as water, which enters the udder will be colored to represent the color of milk. Any suitable form of pigment or dye which provides the color of milk in this case would be effective. Thus, as water is taken in by the toy figure and a liquid representing the color of milk is produced thereby, it appears to the child that the cow is taking in water and producing milk. Moreover, it is preferable that the dye or pigment which is used is an edible material so that the colored liquid discharged from the udder is capable of being ingested by the child.

The dye or pigment is preferably provided in the form of a flat cylindrically shaped pill. The upper plate 46 is provided with a plurality of upwardly struck cylindrically arranged prongs 59 which form a cylindrically shaped pill-receiving area therebetween to receive the dye or pigment containing pill. The area in the plate 46 surrounded by the flanges is provided with an aperture 61 to permit the liquid to contact the pill and absorb the dye or pigment. In this way, the liquid, such as water, will become colored and pass into the udder 44.

The prongs 59 on the plate 46 extend into a socket on a lower skirt portion of the enlarged head 41, and are closely spaced to the walls of the skirt portion. Furthermore, the tablet containing the dye or pigment will be located immediately under the skirt portion so that the substantial portion of the liquid will contact the tablet or pill before being introduced into the udder 44. The liquid which contacts the tablet or pill will pass through the udder between the prongs 59 and through the various apertures 51 in the plate and into the udder 44.

Pivotally connected to the contact head 28 on the tail section 16, by means of a pivot pin 58, is a pawl 60 which engages a ratchet wheel 62, the latter being secured to the torso section 12 by means of a transversely extending pivot 64. The pivot pin 58 is essentially a free-floating pivot, that is, the pin 58 is not connected to the torso 12. However, the pin 58 is vertically shiftable in the manner as shown in FIG. 4.

The ratchet wheel 62 is preferably integral with the pin 64. The ratchet wheel 62 is provided with a plurality of circumferentially spaced, outwardly extending ribs 66 which form a so-called "star wheel" 68. In accordance with the preferred construction, the star wheel 68 is integral with the ratchet wheel 62.

The head section 14 is pivotally mounted within the torso 12 by means of a transversely extending pivot 70. The head section 14 can be pivoted from an upright position, as illustrated in FIG. 1, to a lower, or so-called "drinking position", as illustrated in FIG. 3 of the drawings. In this case, the head section 14 has been shown to be lowered so that the mouth 72 on the head section of the animal figure is located within a pail of water 74.

The head section 14 is provided on each of its longitudinal side walls, within the torso 12, with transversely extending flanges 76 which serve as cams. In this case, it can be observed that each of the flanges 76 have an arcuate portion 78 forming an arcuate camming surface and a relatively flat portion 80 forming a flat camming surface with a shoulder 82 joining the two sections 78 and 80.

By reference to FIGS. 1, 2, 4 and 5, it can be observed that a pair of transversely spaced cam-follower arms 84 are joined together on a transversely extending shaft 86 which is pivotally journalled within bosses 88 formed within the torso sections of the toy animal figure. The cam follower arms 84 are designed to engage the flat cam section 80 and the shoulder 82 in the manner as illustrated in FIG. 3 when the head section 14 is in the lowered or drinking position. In addition, when the head section is in the upper portion as illustrated in FIG. 1, the cam follower arms 84 will ride upon the upper arcuate surface of the camming flanges 76.

Integral with the transversely extending shaft 86 is a retaining arm 90 which rides upon the upper surface of the shaft 64 in the manner as illustrated in FIG. 2. Also mounted on the transversely extending shaft 86 is a rocker arm 92 which is engaged by and operates through the ribs 66 forming part of the star wheel 68.

A torque spring 94 is wound around the transversely extending pivot 70 and is secured at one end to the head section 14 by means of a tab 96. The other end of the spring 94 is restrained within a pair of pins 98 on the interior surface of one of the torso shells. In this way, the head section 14 is normally biased to its upper position as illustrated in FIG. 1 of the drawings.

Thus, when the child player pulls upwardly on the tail 22, the contact head 28 will engage the upper section 30 of the bellows 32 causing an intake of liquid in the manner as previously described. Simultaneously therewith, the pawl 60 will cause rotation of the ratchet wheel 62 in the clockwise direction, reference being made to FIGS. 1 and 4. It can be observed that the pivot pin 58 is essentially free-floating and shifts in a vertical direction with the movement of the tail section 16 and the pawl 60 and is so designed so that the ratchet wheel 62 will only rotate in the one direction. Moreover, the pawl 60 is designed so that the ratchet wheel 62 will be rotated through an arc covering a plurality of the teeth thereon. Three circumferentially located spaces 100, that is, the absence of the ratchet teeth, are located in alignment with each of the three ribs 66 forming the star wheel 68.

The spaces 100 are designed to provide for sufficient angular rotation or advancement of the star wheel 68 to insure that any one of the ribs 66 will not remain in contact with the rocker arm 92. It can be observed that if the star wheel 68 stopped in a position where one of the ribs 66 contacted the rocker arm 92 biasing same in the counterclockwise direction, reference being made to FIG. 4, the cam follower arms 84 would not engage the cam shoulder 82 of the flanges 76. Accordingly, there would be no restraining force to hold the head 14 in the downward or drinking position. The existance of the spaces 100 thereby obviates this problem.

As indicated above, the head section 14 is normally biased to its uppermost position as illustrated in FIG. 1. When it is desired to have the animal drink from the pail or bucket 74, the child player merely pushes the head section 14 down into the pail 74. As this occurs, the cam follower arms will ride along the arcuate cam surfaces 78 until engaged by the shoulders 82 where they hold the head section 14 in the downward position. As the child player continues to pump the tail 22 in a reciprocative manner, the bellows 32 will continue to introduce liquid such as the water into the udder 44. It can be observed that as the ratchet wheel 62 is continuously rotated in the clockwise direction pursuant to pumping movement of the tail 22, one of the ribs 66 of the star wheel will engage the arm 92, thereby pivoting the cam follower arms 84 about the pivot pin 86 in the counterclockwise direction, reference being made to FIG. 1. The cam following arms 84 will then be lifted out of engagement with the shoulders 82. As this occurs, the head section 14 will normally be biased upwardly by means of the spring 94 to its position as illustrated in FIG. 1. In the event that the child player desires to have the animal intake any further liquid, the child player merely pushes the head down into the pail 74 again where the same action is repeated until such time as the head section 14 is biased upwardly to its normal upright position.

Integrally formed with or otherwise rigidly secured to the head section 14 is a rearwardly extending plate 102 having a gear segment 104 projected rearwardly on the periphery of the plate 102. The gear segment 104 cooperates with and is in meshing engagement with a gear segment 106 forming part of a wheel 108, the latter of which is connected to a shaft 110 extending from a sound generating mechanism 112. The sound generating mechanism 112 is essentially conventional in its construction and, in this case, generates a sound representative of the toy figure. Thus, where the toy figure is representative of a cow, the sound generating mechanism 112 will generate a sound when turned from a first position to a second position, typically at a 120° angle between the first and second positions. It can be observed that the gear wheel 108 will rotate as the head section 14 is shifted upwardly and downwardly. In the present invention, the "moo" sound will be generated when the head section 14 is shifted from the drinking to the upper position. However, by rotating the sound generating mechanism, the sound could be generated when pushing the head section to the drinking position. The head movement is limited by a pair of stops 111 on the plate 102 which are engageable by inwardly struck tabs 113 on the torso section.

Referring now to FIG. 10, it can be observed that the intake aperture 72 in the mouth portion of the head section 14 leads into a flapper valve 114 retained by a pair of spaced apart, inwardly struck flanges 116 in the head section 14. Other forms of valves, as for example, a one-way check valve, could be used in place of the flapper valve. In this case, the flapper valve includes a shiftable disc 118 located within a fluid inlet chamber 120. Moreover, the disc 118 is provided with flow-through slots 123 along the periphery of the disc 118 in order to permit fluid flow into the chamber 120 when the disc 118 is removed from the seat 122. In accordance with this construction, the liquid in the pail 74, such as water, can enter into the tube 38 which is connected to the outlet portion of the flapper valve 114 and cannot be discharged through the opening 72. In the event that the udder 44 and the bellows 32 should become filled, an overflow discharge means is provided.

A predetermined number of pumping cycles of the tail 22 operates as a means to limit the intake of liquid into the udder 44. However, it can be observed that the child could push the head section 14 of the animal into the trough a second time after the first cycle of reciprocative pumping actions of the tail and thereafter to continue to pump the tail. This activity would result in an excess liquid being introduced into the udder 44. For this purpose, one of the teats 52 is provided with an overflow chamber 124 as illustrated in FIGS. 6 and 7 of the drawings. It can be observed that the overflow chamber 124 includes an upstanding wall 126 within the udder 44 which extends around an opening 128 leading into the last-mentioned teat 52. The lower portion of the teat 52 is provided with an enlarged aperture 130 permitting the immediate draining of any excess liquid which flows over the wall 126 and into this latter teat 52. In addition, the overflow chamber 124 and the opening 128 serve the added function of providing an exit for air in the udder 44 being displaced by incoming water.

It should be understood in connection with the present invention that the toy animal figure could adopt other animal characterizations other than that of a toy cow, as for example, goats, lambs, and the like, and essentially any form of animal which is capable of drinking water and producing milk. Thus, the toy animal figures of the present invention have both substantial play value as well as educational value for children in that they teach the children that an animal can ingest water and ultimately produce milk in the udder portion thereof. It should also be understood that a toy water trough resembling the type normally used for cows and other animals could be provided in place of a pail or bucket.

Each of the components of the toy animal figure of the present invention can be constructed of any of a number of moldable plastics including polyethylene, polystyrene, polybutadiene, and various vinylidene copolymers, etc. Any of a number of conventional plastic molding operations may be used to form each of the respective components at a relatively low cost, including blow-molding, thermoforming, injection molding, and the like. One of the important aspects of the present invention is that each of these components can be very easily assembled in a minimum amount of time in order to construct the animal figure. Even moreso, the animal figure of the present invention is uniquely designed so that it meets all of the required safety ordinances and laws required for use in the play by children.

Thus, there has been illustrated and described a unique and novel toy milkable animal figure which fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by Letters Patent is:

1. A liquid drinking and discharging toy animal apparatus comprising:

(a) a body having a torso with front and rear ends;

(b) a head mounted on the front end for movement from an upper to a lower position, said head having an opening for the intake of a liquid;

(c) a chamber on said body for receiving the liquid and representing an udder of said animal apparatus;

(d) an appendage on said torso capable of being shifted to cause an intake of liquid for introduction into said udder;

(e) means operatively associated with said head and said appendage for maintaining said head in said lower position for a predetermined number of shifting movements of said appendage;

(f) means operatively associated with said head for causing said head to move to said upper position after said predetermined number of shifting movements of said appendage; and (g) teat means on said udder connected to and defining an outlet from said chamber, said teat means being flexible and manually squeezable to cause the release of liquid through said outlet.

2. The apparatus of claim 1 further characterized in that said appendage is a tail on the rear end of said torso and said shiftable movement is a reciprocative movement thereof.

3. The apparatus of claim 1 wherein the means for causing said head to move to the upper position is a coil spring means, normally biasing said head to said upper position.

4. The apparatus of claim 1 wherein the means for holding said head in the lower position is a camming arm which engages a shoulder formed on said head.

5. The apparatus of claim 4 wherein interrupting means is operatively associated with said camming arm for releasing said camming arm from said shoulder after the predetermined number of shifting movements of said appendage.

6. The toy milkable animal figure of claim 5 wherein valve means is located in an inlet to said teat on said udder for control of liquid flow between said udder and said teat.

7. The toy milkable animal figure of claim 5 further comprising a body of white colored dye or pigment to be disposed in relation to the udder to color water or other liquid introduced into the chamber a white color simulating the appearance of milk.

8. The toy milkable animal figure of claim 1 wherein said frame comprises a body portion and leg portions adapted to support said body portion elevated above a supporting surface, said chamber being disposed at the rear of said body portion and with said udder being elevated above said supporting surface.

9. The toy milkable animal figure of claim 1 wherein said toy milkable animal figure has a shape and appearance to simulate a cow.

10. A liquid drinking and discharging toy animal apparatus, said apparatus comprising:

(a) a body having front and rear ends and a shape and design to characterize an animal;

(b) a head mounted at the front end of said body and having a mouth opening for the intake of a liquid;

(c) a liquid receiving chamber supported at the rear end of said body and having a portion extending outwardly from said body, said portion being representative of an udder of said animal;

(d) pumping means operatively connected to said chamber for introducing liquid through said mouth opening into said chamber, said pumping means including an expandable and compressible bladder which is expandable and compressible through reciprocative movement of an appendage representing a tail on said apparatus;

(e) an outwardly extending element on said udder representing a teat, said teat having liquid discharge means at one end thereof and being flexible and manually squeezable to discharge liquid from said chamber through said discharge means;

(f) and valve means at the other end of said teat adjacent to said udder portion for controlling liquid flow between said udder portion and said teat, so that during manually manipulating said teat, said valve will prevent further liquid flow between said teat and said udder and the liquid in said teat will be discharged; said apparatus further including overflow means for permitting outward flow through another outwardly extending element on said udder portion only when excess liquid is introduced into said udder.

11. The toy animal of claim 10 further characterized in that an inlet tube extends from said mouth opening to said chamber for introducing liquid into said chamber.

12. The toy animal apparatus of claim 11 wherein said inlet tube includes a one-way flow valve which controls flow through said inlet tube to said chamber.

13. The toy animal apparatus as called for in claim 10 wherein said valve means closes and said discharge means opens upon manual manipulation of said teat and said valve means opens and said discharge means closes immediately after manual manipulation of said teat.

14. The toy animal apparatus of claim 10 wherein a body of white colored dye or pigment may be disposed in relation to the chamber to provide water or other liquid introduced into the chamber with a white color simulating the appearance of milk.

15. A liquid drinking and discharging toy animal apparatus, said apparatus comprising:

(a) a body having front and rear ends and a shape and design to characterize an animal;

(b) a head mounted at the front end of said body and having a mouth opening for the intake of a liquid;

(c) a liquid receiving chamber supported at the rear end of said body and having a portion extending outwardly from said body, said portion being representative of an udder of said animal, (d) a first outwardly extending element on said udder representing a first teat in fluid communication with said chamber and being flexible and manually manipulatable to discharge liquid from said chamber;

(e) liquid intake means operatively connected to said chamber and mouth opening for introducing liquid through said mouth opening and into said chamber;

(f) means for limiting the amount of liquid introduced into said chamber through said mouth opening;

(g) overflow means forming part of said portion of said chamber, said overflow means comprising a second outwardly extending element on said chamber representative of a second teat and having a first opening communicating with said chamber, a wall surrounding said opening and extending generally upwardly into said chamber so that if the liquid in said chamber reaches a level of the wall, the liquid will flow into said second teat;

(h) and means forming an opening at the lower end of said second teat permitting discharge of liquid overflowing into said second teat.

16. The toy animal apparatus of claim 15 wherein an inlet tube extends from said mouth opening to said chamber for introducing liquid into said chamber, and that said liquid intake means comprises a pumping means.

17. A liquid drinking and discharging toy animal apparatus comprising:

(a) a body having a torso with front and rear ends;

(b) a head mounted on the front end for movement from an upper to a lower position, said head having an opening for the intake of a liquid;

(c) a chamber on said body for receiving a liquid and representing an udder of said animal apparatus;

(d) tube means cooperatively connecting said opening on said head and said chamber so that liquid introduced through said head opening may be delivered to said chamber;

(e) an extension on said udder representing a teat and communicating with said chamber for having liquid in said chamber introduced into said teat, said teat being formed of a flexible resilient material capable of being manually manipulated, said teat having a discharge means at a lower end thereof for discharging liquid therein upon manual manipulation thereof;

(f) an appendage on said torso capable of being shifted for pumping liquid through into said udder on reciprocative movement of said appendage;

(g) means operatively associated with said head and said appendage for maintaining said head in said lower position for a predetermined number of shifting movements of said appendage;

(h) means operatively associated with said head for biasing said head to said upper position after said predetermined number of shifting movements of said appendage; and (i) valve means at the other end of said teat adjacent to the position at which said teat is connected to said udder for controlling liquid flow into said teat so that during manual manipulation of said teat, said valve will restrict further liquid flow between said teat and said udder and the liquid in said teat will be discharged during such manual manipulation, said valve means closing and said discharge means opening upon manual manipulation of said teat and said valve means opening and said discharge means closing immediately after manual manipulation of said teat.

18. The apparatus of claim 17 wherein a second teat extends from said udder and has a first open end communicating with said chamber and a second lower open end, a wall extending around said first open end upwardly into said chamber so that excess liquid in said chamber will flow into said second teat when the level of the liquid in said chamber is above the height of said wall.

19. The apparatus of claim 18 wherein said appendage is a tail on the rear end of said torso and said shiftable movement is a reciprocative movement thereof.

20. The toy milkable animal figure of claim 17 wherein said chamber is openable to provide access to the interior thereof and reclosable to provide a liquid holding chamber.

21. The toy milkable animal figure as called for in claim 20 wherein the chamber comprises a relatively rigid member releasably mounted to said frame, and the portion of said chamber representing said udder is made of a flexible, resilient material and is releasibly attachable to said relatively rigid member.

22. The toy milkable animal figure of claim 20 further comprising a body of white colored dye or pigment to be disposed in relation to the chamber to provide the water or other liquid introduced into the chamber with a white color simulating the appearance of milk.

23. The toy milkable animal figure of 22 wherein said relatively rigid member includes an outwardly extending section capable of receiving a tablet of the white colored dye or pigment.

* * * * *